US006151716A

United States Patent [19]

Patterson et al.

[11] Patent Number: 6,151,716

[45] Date of Patent: Nov. 28, 2000

[54] DISPOSABLE PAPER BIB

[76] Inventors: Melanie S. Patterson; Robert B. Patterson, both of 332 First Ave., Belle Vernon, Pa. 15012

[21] Appl. No.: 09/425,879

[22] Filed: Oct. 22, 1999

Related U.S. Application Data

[63] Continuation-in-part of application No. 08/827,889, Apr. 14, 1997, abandoned, which is a continuation of application No. 08/661,355, Jun. 11, 1996, abandoned.

[51] Int. Cl.[7] ..... A41B 13/00

[52] U.S. Cl. ..... 2/49.1

[58] Field of Search ..... 2/49.1, 49.4, 49.5

[56] References Cited

U.S. PATENT DOCUMENTS

| | | | |
|---|---|---|---|
| 3,001,646 | 9/1961 | Cooper . | |
| 3,299,440 | 1/1967 | Grable . | |
| 3,583,558 | 6/1971 | Davis | 242/160.1 |
| 4,423,523 | 1/1984 | Bodner et al. | 2/49.4 |
| 4,622,698 | 11/1986 | Heyman et al. | 2/48 |
| 4,884,299 | 12/1989 | Rose | 206/390 |
| 5,414,903 | 5/1995 | Porteous | 24/9 |
| 5,809,568 | 9/1998 | Morris-Jones | 2/49.1 |

*Primary Examiner*—John J. Calvert
*Assistant Examiner*—Shirra L. Jenkins
*Attorney, Agent, or Firm*—John D. Gugliotta

[57] ABSTRACT

A roll of perforated, disposable bibs are provided, where a plurality of individual bib elements are linearly aligned in a perforated fashion. Each bib element includes a convex upper indentation protruding inward into the main planar surface at the upper boundary of the bib which mates with a concave lower protrusion extending downward from the main planar surface at a lower boundary of an adjacent bib. The concave lower protrusion functions also as a lap protective element, and the convex upper indentation aids in the formation of a neck slot perforation placed near, but slightly below the uppermost edge, and formed in a symmetric, curvilinear manner, having an upward arching lowermost point that smoothly transitions to horizontal at each end of the bib in a manner similar to the convex upper indentation.

5 Claims, 4 Drawing Sheets

DISPOSABLE PAPER BIB

RELATED APPLICATIONS

The present invention is a continuation in part of U.S. Ser. No. 08/827,889, filed on Apr. 14, 1997, which was a continuation of parent application U.S. Ser. No. 08/611,355 filed Jun. 11, 1996, both of which are herein incorporated by reference and now abandoned.

BACKGROUND OF THE INVENTION

1. Field of the Invention

In the related art, several baby bibs designed for temporary use are known. Of particular interest are U.S. Pat. Nos. 3,329,969, to Farber, et al., and 4,620,323, to Tepper, wherein disposable baby bibs are disclosed for protection against drips. The bibs described by these patents are expensive to manufacture and are generally not easily stored and distributed in mass quantities. Also of interest is U.S. Pat. No. 4,884,299, to Rose, which discloses dispensing means for disposable bibs. While these patents show some of the common features incorporated in baby bibs, none of these bibs prevent the spillage of food, liquid or other matter onto the bib wearer's lap and none provide enhanced protection to the upper portion to the bib wearer's shirt and collar. In particular, Rose fails to teach the formation of the upper indentation of one bib element that mates with a concave lower protrusion of a previous bib element when formed in a roll, thereby allowing this concave lower protrusion to also function as a lap protective element in each of its commercial embodiments.

A bib incorporating the cost savings and benefits of standard rolled paper towels or packaged napkins and providing protection to the bib wearer's shirt and lap would overcome the problems associated with the prior art. Consequently, a need has been felt for providing such a disposable bib that is inexpensive to manufacture and provides greater protection from spilled solids, liquids and other matter.

SUMMARY OF THE INVENTION

It is therefore an object of the present invention to provide an improved disposable paper bib.

It is another object of the present invention to provide a multi-layered disposable bib that absorbs foods and liquids in order to contain spills and to avoid soiling of the bib wearer's clothing, the chair in which the bib wearer is sitting, and the floor surface below the bib wearer. The bib wearer may be a child, a senior citizen, a dental or medical patient or any other individual needing protection from spills.

Yet another object of the present invention is to provide an inexpensively manufactured and disposable bib that is easily dispensed in a perforated roll or fan-fold manner.

It is a feature of the present invention to provide an improved absorbent and disposable bib that includes an absorbent first layer that is contained by a non-permeable second layer. Other features of the present invention include a multilayered bib wherein a non-permeable layer is enclosed by two absorbent layers or, for example, wherein the bib is constructed of a layer of absorbent material applied to non-permeable material which is then applied to absorbent material which is then further applied to non-permeable material and so on.

In one embodiment of the invention, a disposable paper bib is provided that includes a first, liquid non-permeable bottom layer having a first surface and a second surface; a second, absorbing layer for absorbing liquids which is applied to the second surface of the non-permeable bottom layer; and means for securing the bottom layer and the absorbing layer, wherein the securing means prevents misalignment of the layers and surrounds the bib perimeter which is defined by the respective edges of the bottom and absorbing layers.

According to another embodiment of the present invention, a disposable paper bib is provided that is constructed of paper materials with a waterproof backing. Similar in shape to traditional bibs, this baby and senior care accessory is disposable after use. Latex pressure sensitive adhesive secure two tabs located behind the bib wearer's neck to maintain the proper position of the bib. To use disposable bibs, a care giver removes a single bib from the packaging, places it across the bib wearer's chest and affixes the tabs behind the bib wearer's neck. Should the bib become soiled, the care giver may remove and discard the bib and replace it with a fresh one.

In a further embodiment of the invention, a bib is provided which extends below the waist of the bib wearer and forms a pouch to catch food, liquids and other matter which has spilled into the bib wearer's lap. In a still further embodiment, a bib is provided which extends to the knees of the bib wearer. In this way substantially all of the bib wearer's spills may be contained in the bib wearer's lap without soiling the bib wearer's clothes or leading to further spillage to the chair or floor below the bib wearer. It is contemplated that the extended bib will find its greatest use in the elderly care market.

In yet another embodiment of the invention, a tuck-flap is provided which may be tucked into the collar of the bib wearer's shirt. The tuck-flap provides an extra and comprehensive measure of protection from spillage as it ensures that the shirt collar is protected and also substantially eliminates any possibility of seepage of food or liquid between the bib wearer's shirt and neck.

Advantages of the present invention include an improved, easy to use, inexpensive, convenient, and disposable method of providing spill protection for infants or senior citizens without the expense of trouble of traditional fabric bibs.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
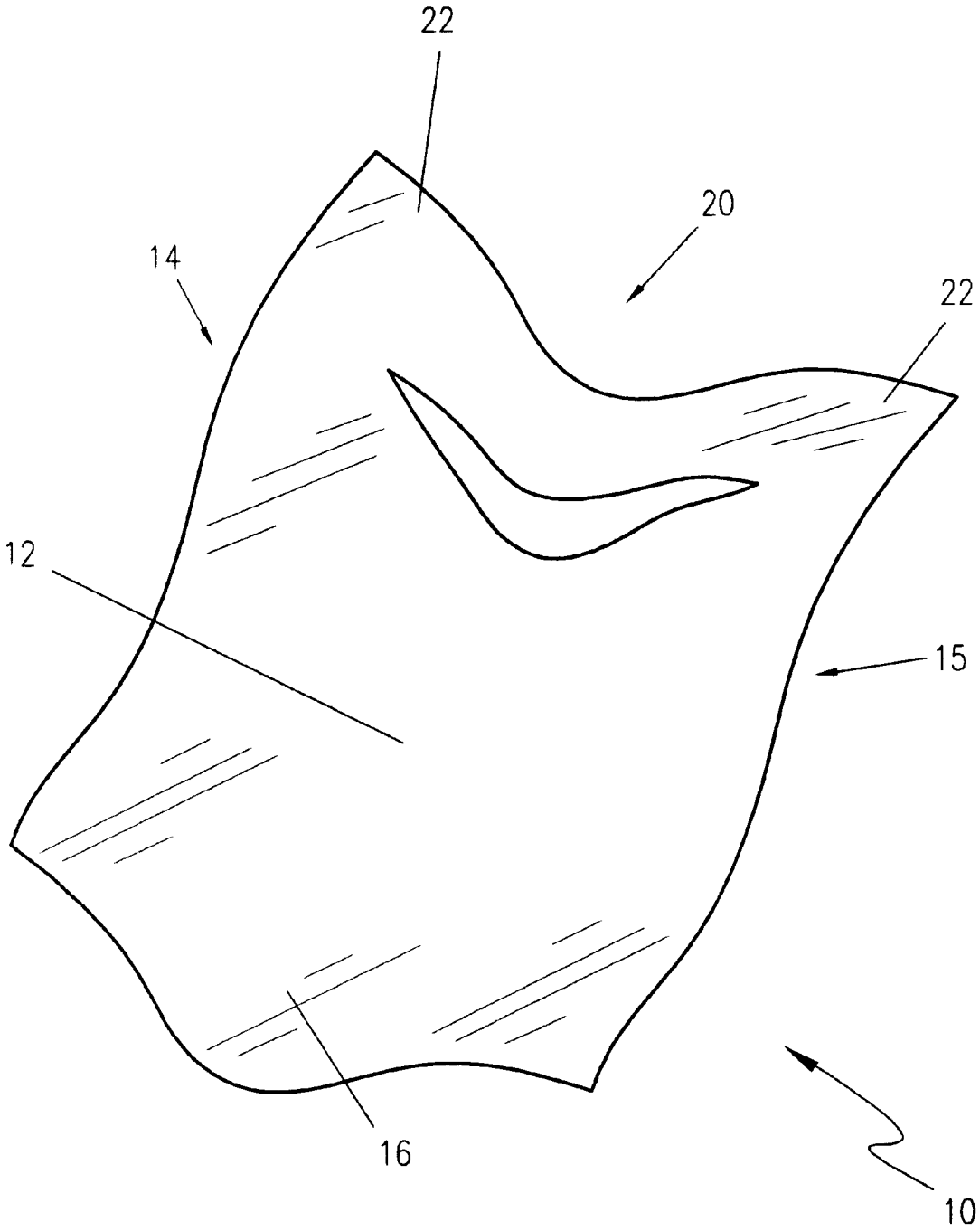
FIG. 1 is an exploded perspective view of a disposable bib for absorbing liquids, shown in accordance with one preferred embodiment of the present invention.

Referring now to the figures, a paper bib 10 is shown, according to the present invention, forming a generally rectangular planar surface 12 having a first vertical edge 14 parallel to and opposite from a second vertical edge 15. As will be described in greater detail below, it is envisioned in a preferred embodiment that a plurality of linearly aligned bibs 10 will be formed, manufactured, packaged, and provided in a rolled form for ease of dispensing and use. To accommodate the manufacturing of such a rolled assembly, it is envisioned that the first vertical edge 14 be straight and smooth, and parallel to the second vertical edge 15, which is also envisioned to be equally straight and smooth. Extending downward from the main planar surface 12 at the lower boundary of the bib 12 is a concave lower protrusion 16. In its best mode, this lower protrusion is formed in a symmetric, curvilinear manner having an upward arching lowermost point that smoothly transitions at each end to a horizontal extension at each of the side-most portions of the lower perimeter edge of the bib 10. In addition to assisting in the formation of the upper indentation, as is described in more detail below, this concave lower protrusion 16 also functions as a lap protective element in each of its commercial embodiments. Protruding inward into the main planar surface 12 at the upper boundary of the bib 12 is a convex upper indentation 20. In its best mode, this upper indentation 20 is formed in a symmetric, curvilinear manner having an upward arching lowermost point that smoothly transitions at each end to a horizontal extension at each of the side-most portions of the upper perimeter edge of the bib 10 and forming a pair of opposed upper tab elements 22. As will be described in greater detail below, it is envisioned in a preferred embodiment that a plurality of linearly aligned bibs 10 will be formed, manufactured, packaged, and provided in a rolled form for ease of dispensing and use. To accommodate the manufacturing of such a rolled assembly, it is envisioned that the convex upper indentation 20 is capable of mating smoothly with the concave lower protrusion 16 of a separate but adjacent bib 10, thereby allowing such a roll of preformed bibs to be manufactured and packaged in a similar manner as and utilizing similar conventional equipment as is currently utilized in the manufacture and packaging of perforated rolled paper towels. In this manner, it has been found that a perforation formed at two tears per inch would provide sufficient bib element separation.

For purposes of disclosure of best available mode, and not by way of limitation of the design or functionality of the present invention, it is felt that a common scheme, utilizing the present teachings, would functionally suite various categories of users. For example, it is felt that for use with newborns weighing generally up to 12 pounds, a smaller sized bib element 10 having an overall width of approximately six inches and an overall length of approximately eight inches would provide a sufficiently large planar surface 12 for coverage for the specific intended use. Similarly, it is felt that for use with infants weighing generally between thirteen to twenty four pounds, and toddlers between twenty five and 32 pounds, an intermediate sized bib element 10 having an overall width of approximately twelve inches and an overall length of approximately eighteen inches would provide a sufficiently large planar surface 12 for coverage for the specific intended use. Finally, it is felt that for use with senior care applications for use with adults, a larger sized bib element 10 having a sufficiently large planar surface 12 for coverage for the specific intended use.

Figure 2:
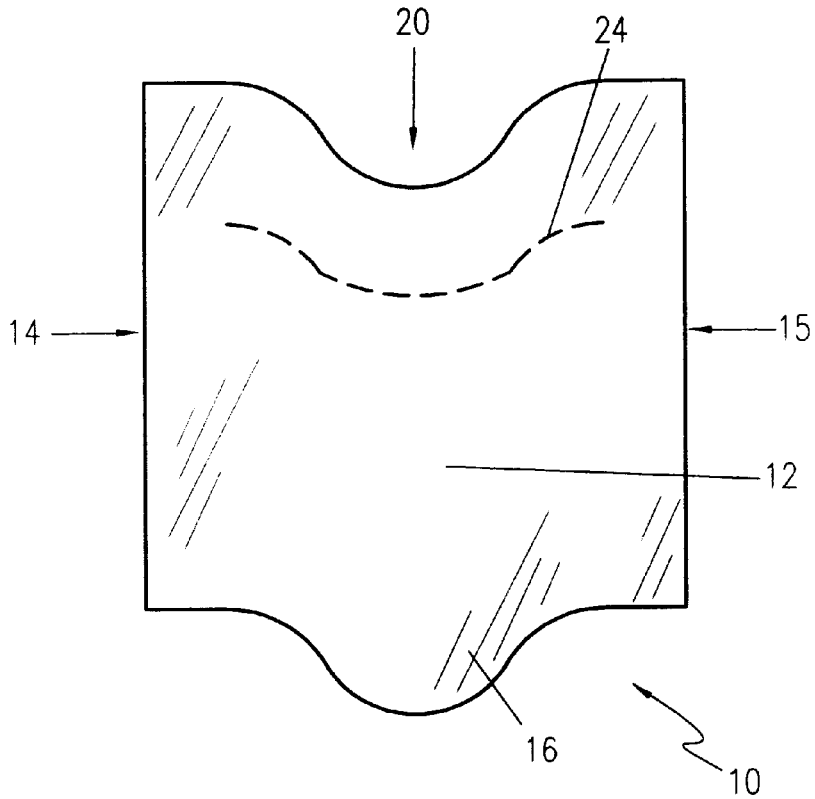
FIG. 2 is a top view thereof.
Figure 3:
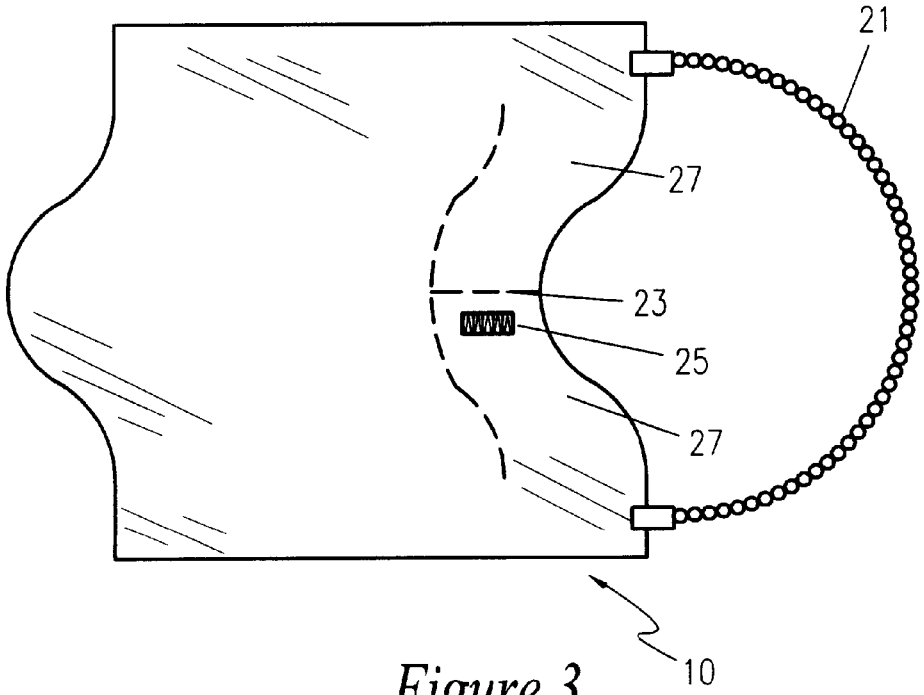
FIG. 3 is a top view of an alternate embodiment showing a separate supporting means.
Figure 4:
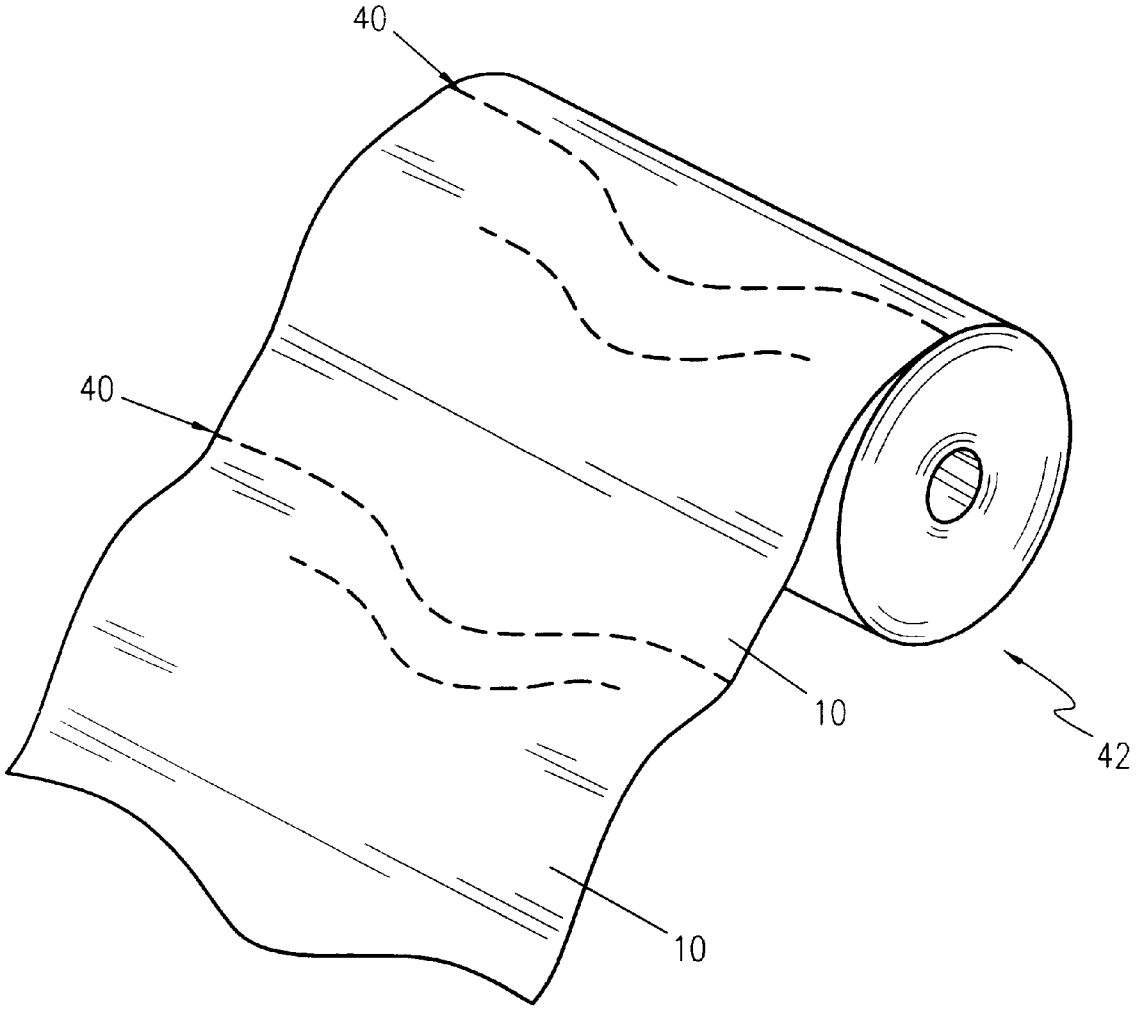
FIG. 4 is a perspective view of a plurality of the bibs depicted in FIG. 1, positioned into a roll with perforations at regular intervals to provide individual bibs that may be separated from the roll.
Figure 5:
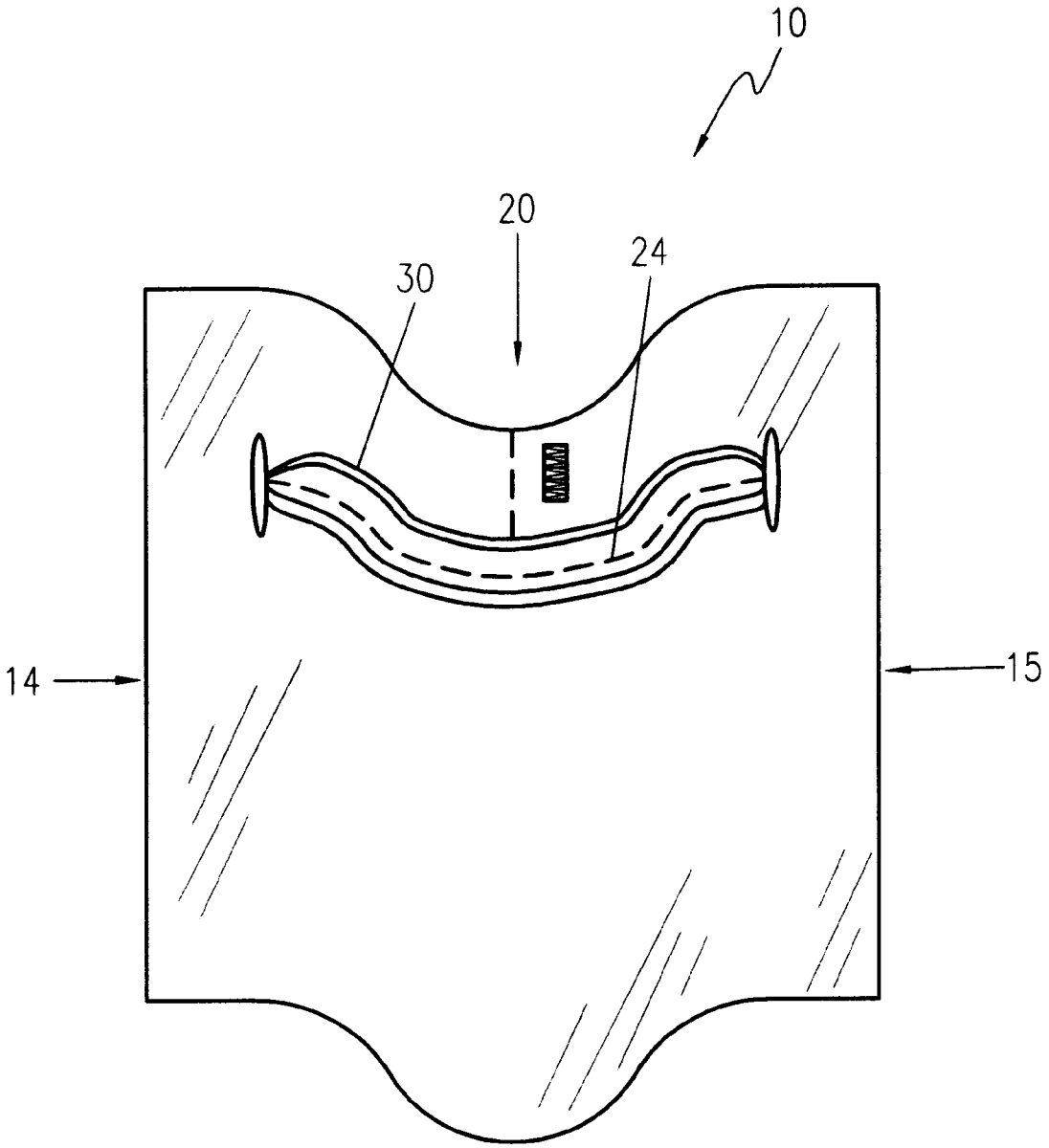
FIG. 5 is a close up partial plan view of neck slot perforation 24 for use with the preferred embodiment of the present invention.

Referring to FIG. 2–5, an additional functional element of the present invention includes a supporting means for retaining an individual bib element 10 in a vertical, supported location below a user's neck, over the user's chest, and optionally above the user's lap. It is envisioned that a variety of such supporting means can be utilized, individually or in combination, for providing this retaining function. For example, a separate environmental structure 21, such as a chain, clip, strap, or the like, can be mechanical affixed to each upper tab 22 and around the wearer's neck in order to support the bib element 10. However, the preferred embodiment is incorporated in a neck slot perforation 24 placed near, but slightly below the uppermost edge, and formed in a symmetric, curvilinear manner, having an upward arching lowermost point that smoothly transitions to horizontal at each end of the bib 10 in a manner similar to the convex upper indentation 20. In its best mode this head opening perforation is formed at three tears per inch. It is envisioned that the overall width of this neck slot perforation 24 would be approximately six inches, centered about the vertical centerline, for the infant sized bib element, and approximately eight inches, centered about the vertical centerline, for the toddler sized bib element. In this manner, a similar overall outer dimension can be used to accommodate the various envisioned functions. Additionally, a flap perforation 23 would be provided traversing the bib surface 12 between the convex upper indentation 20 and the neck slot perforation 24 such that by separating the flap perforation 23 a pair of neck flaps 27 are formed for purposes of circumscribing the users neck. An attached flap connection means 25, herein shown as a dual sided tape element, allows for connection of the neck flaps 27 in a removable manner. Further, it is alternately envisioned that this neck slot perforation 24 could be strengthened by applying an adhesive bead 30 along the orifice perimeter created by the neck slot perforation 24. This would allow the user to form a neck opening orifice by separating the neck slot perforation 24, while providing an additional level of strength to prevent said orifice from causing the tearing of the bib element material completely to the side edge.

Alternately, and potentially additionally it is envisioned that adhesive tabs 28 can be provided to augment the supporting means. Such adhesive tabs are envisioned as including conventional tape, or specifically pressure sensitive latex adhesive.

Finally, although various materials of construction, such as paper or plastic in an otherwise conventional manner, for purposes of disclosing the preferred embodiment the preferred commercial bib element 10 is formed of a nonwoven product named AIRTEX™, a smooth calendered, lower Tinting fabric composed of virgin bleached wood pulp fiber and a polymer emulsion.

2. Operation of the Preferred Embodiments

The bib 10 can be utilized in the same manner as conventional fabric or plastic bibs. In one preferred embodiment shown in FIG. 4, the bib is manufactured as a length of a plurality of bibs 10 which are perforated at regular intervals, along perforations 40. An individual bib 10 may be easily separated from the roll 42 along a perforation 40, in a manner similar to separating a paper towel from a paper towel roll. Perforations 40 may include any combination of short and long slits or scores separated by short and long areas of bib material. Scores are meant to include indentations in the bib material that do not extend all the way through the bib material.

Thus, there has been shown and described absorbent bibs for absorbing spilled or dripped liquids, solids and other matter which fulfills all the objects and advantages sought therefore. Many changes, modifications, variations and other uses and applications of the subject invention will, however, become apparent to those skilled in the art after considering this specification and the accompanying drawings which disclose preferred embodiments thereof. All such changes, modifications, variations and other uses and applications which do not depart from the spirit and scope of the invention are deemed to be covered by the invention, which is limited only by the claims which follow.

What is claimed is:

1. A bib forming a generally rectangular planar surface having a first vertical edge parallel to and opposite from a second vertical edge, said first vertical edge being straight and smooth, and parallel to said second vertical edge which is also straight and smooth, said bib comprising:

a concave lower protrusion extending downward from the mani planar surface at a lower boundary of said bib;

a convex upper indentation protruding inward into the main planar surface at the upper boundary of the bib, wherein said convex upper indentation is formed in a symmetric, curvilinear manner having an upward arching lowermost point that smoothly transitions at each end to a horizontal extension at each of the side-most portions of the upper perimeter edge of the bib and forming a pair of opposed upper tab elements;

supporting means comprising a neck slot perforation placed near, but slightly below the uppermost edge, and formed in a symmetric, curvilinear manner, having an upward arching lowermost point that smoothly transitions to horizontal at each end of the bib in a manner similar to the convex upper indentation.

2. The bib of claim 1, wherein said neck slot perforation is formed at three tears per inch.

3. The bib of claim 1, further comprising an adhesive bead along the orifice perimeter created by the neck slot perforation, thereby allowing the user to form a neck opening orifice by separating the neck slot perforation but preventing said orifice from causing the tearing of the bib element material completely to the side edge.

4. A plurality of linearly aligned, rolled bibs adapted for disposable use, where each said roll of bibs is comprised of a plurality of individual bib elements, each said bib element comprising:

a generally rectangular planar surface having a first vertical edge parallel to and opposite from a second vertical edge, said first vertical edge being straight and smooth, and parallel to said second vertical edge which is also straight and smooth;

a convex upper indentation protruding inward into the main planar surface at the upper boundary of the bib;

a concave lower protrusion extending downward from the main planar surface at a lower boundary of said bib to assist in the formation of the upper indentation the convex upper indentation by mating smoothly with the concave lower protrusion of a separate but adjacent bib element within said roll of bibs, said concave lower protrusion functioning also as a lap protective element;

said concave lower protrusion is formed in a symmetric, curvilinear manner having an upward arching lowermost point that smoothly transitions at each end to a horizontal extension at each of the side-most portions of the lower perimeter edge of the bib; and said convex upper indentation is formed in a symmetric, curvilinear manner having an upward arching lowermost point that smoothly transitions at each end to a horizontal extension at each of the side-most portions of the upper perimeter edge of the bib and forming a pair of opposed upper tab elements;

supporting means formed on each said bib element, each said supporting means comprising a neck slot perforation placed near, but slightly below the uppermost edge, and formed in a symmetric, curvilinear manner, having an upward arching lowermost point that smoothly transitions to horizontal at each end of the bib in a manner similar to the convex upper indentation;

and wherein a plurality of linearly aligned bibs elements are formed, manufactured, packaged, and provided in a rolled form for ease of dispensing and use.

5. The rolled bibs of claim 4, further comprising an adhesive bead along the orifice perimeter created by the neck slot perforation, thereby allowing the user to form a neck opening orifice by separating the neck slot perforation but preventing said orifice from causing the tearing of the bib element material completely to the side edge.

* * * * *